US009834989B2

(12) United States Patent
Lanzafame

(10) Patent No.: US 9,834,989 B2
(45) Date of Patent: Dec. 5, 2017

(54) LADDER LEG SHOE HINGES 90 DEGREES AND SLIDES UP

(71) Applicant: Philip F. Lanzafame, Poulsbo, WA (US)

(72) Inventor: Philip F. Lanzafame, Poulsbo, WA (US)

(73) Assignee: Philip F. Lanzafame, Poulsbo, WA (US)

( * ) Notice: Subject to any disclaimer, the term of this patent is extended or adjusted under 35 U.S.C. 154(b) by 0 days.

(21) Appl. No.: 15/197,272

(22) Filed: Jun. 29, 2016

(65) Prior Publication Data

US 2016/0305186 A1 Oct. 20, 2016

Related U.S. Application Data

(63) Continuation of application No. 14/184,662, filed on Feb. 19, 2014, now abandoned.

(60) Provisional application No. 61/850,566, filed on Feb. 20, 2013.

(51) Int. Cl.

| | |
|---|---|
| ***E06C 7/42*** | (2006.01) |
| ***E06C 7/44*** | (2006.01) |
| *E06C 7/46* | (2006.01) |

(52) U.S. Cl.

CPC ..... *E06C 7/426* (2013.01); *E06C 7/44* (2013.01); *E06C 7/46* (2013.01)

(58) Field of Classification Search

CPC ..... E06C 7/426; E06C 7/46; E06C 7/42

See application file for complete search history.

(56) References Cited

U.S. PATENT DOCUMENTS

| | | | | | |
|---|---|---|---|---|---|
| 544,520 | A * | 8/1895 | Reiffenstein | E06C 7/46 | 182/111 |
| 1,379,808 | A * | 5/1921 | Fies | E06C 7/46 | 182/111 |
| 2,691,479 | A * | 10/1954 | Sharp | E06C 7/46 | 182/109 |
| 3,456,757 | A * | 7/1969 | Sain | E06C 7/46 | 182/111 |
| 4,415,062 | A * | 11/1983 | Shaw | E06C 7/46 | 182/109 |
| 5,370,203 | A * | 12/1994 | Kiska | E06C 7/46 | 182/109 |
| 5,678,656 | A * | 10/1997 | Lanzafame | E06C 7/44 | 182/111 |
| 6,145,618 | A * | 11/2000 | Verenski | E06C 7/46 | 182/109 |
| 2008/0134620 | A1* | 6/2008 | Contasti | E04B 1/2608 | 52/712 |

* cited by examiner

*Primary Examiner* — Alvin Chin-Shue

(74) *Attorney, Agent, or Firm* — Carlos P. Garritano; Tucker Ellis LLP

(57) ABSTRACT

Improvements to the leg extension of an adjustable ladder leveler and, more generally, improvements to ladder legs. A shoe with a claw that folds to be parallel to the ladder leg and then slides upward with respect to the leg thereby becoming locked into position so that it cannot move away from being parallel so long as weight is applied on the ladder. If the shoe is on an extension, as the shoe slides up, it engages a safety bar that prevents release of the extension.

4 Claims, 9 Drawing Sheets

Figure 1 – prior art

Figure 2 – prior art

LADDER LEG SHOE HINGES 90 DEGREES AND SLIDES UP

This application is a continuation of application Ser. No. 14/184,662 filed Feb. 19, 2014 and claims priority from my provisional application 61850566 filed Feb. 20, 2013 which is hereby incorporated by reference.

BACKGROUND

I invented a ladder leveler that provides adjustable extensions to ladder legs, U.S. Pat. No. 5,678,656. That leveler is shown in FIGS. 1 and 2. The leveler includes an outer housing 41 secured with fastening bolts 57 to an outer ladder rail 29 which holds ladder rungs 23. It includes a leg extension 71 that is movable within a channel 43 in the outer housing 41 from a retracted position to an extended position. It includes a positive locking engagement system including a pawl 73 mounted on a pivot pin 79 and biased into engagement by a pawl spring 81. The pawl engages ratchet teeth 49 on a toothed ratchet bar 47 held in place by fasteners 51 in a recess 45. The greater the force applied to the ladder rail 29, the greater the force applied to the locking engagement between the outer housing 41 and the leg extension 71.

A release lever 75 on the pawl 73 releases the pawl when activated by hand. A safety bar (shown in FIG. 2 without a reference numeral) extends from the center of the shaft of a bolt 33 that is bolted to a support foot 27 to the pawl 73, contacting the pawl close to its pivot hole 77, such that force applied to the support foot 27 presses the safety bar against the pawl 73 and locks the pawl in position.

The support foot 27 is secured to the leg extension 71 with the securing bolt 33 which acts as a hinge pin by passing through an oblong securing bolt aperture in the leg extension, and is held in place with a securing nut 35. The support foot 27 includes a rubber friction pad tread 31.

The leveler also includes a retraction spring 53 coupled at one end to the outer housing at a spring fastener 55 and at the other end to the leg extension 71. The retraction spring continually applies an upward biasing force on the leg extension. To facilitate the extension and retraction of the extension leg 71 into and out of the outer housing 41, a foot pedal 101 is secured to the front portion of the extension leg 71 with a foot pedal pivot pin 103. Pressing on the pedal opposes the force of the retraction spring 53.

SUMMARY OF THE INVENTION

The invention provides improvements to the leg extension of my prior ladder leveler and, more generally, improvements to ladder legs.

In one aspect, the invention is a ladder leg with a nailable, pivoting shoe, comprising a ladder leg having a bottom end with a pivotable structure at the bottom end; pivotably coupled to the pivotable structure, a ladder shoe having a planar bottom surface, the bottom surface being a surface of a support structure of the ladder shoe adapted to apply weight of the ladder to a planar surface on which the ladder rests when erected; at least one hole in the support structure, the hole passing through the support structure perpendicular to the planar bottom surface of the ladder shoe; and the hole having a minimum diameter of at least 1/16 inch and no part large enough to allow passage of a 3/8 inch sphere.

The hole may be round or a slot. The support structure may include a metal portion and a rubber portion and the rubber portion forming the planar bottom surface of the ladder shoe, in which case the at least one hole in the support structure passes through the metal portion and aligns with a hole in the rubber portion. The hole in the rubber portion may be smaller than the hole in the metal portion with which it is aligned so that the hole in the rubber portion is enlarged by entry of a penetrating object that is smaller than the hole in the metal portion but larger than the hole in the rubber portion and the penetrating object is thereby gripped by the rubber portion. The planar bottom surface of the ladder shoe may comprises multiple, discontinuous bottom surfaces in a single plane, the lowest parts of the rubber tread as shown in the figures. The support structure may include, on a top surface surrounding the hole, a raised edge that supports a head of a nail inserted into the hole such that the head can be easily engaged by a forked claw for removing the nail. The leg may be an extendable and adjustable leg.

In another aspect, the invention is a retractable ladder leveler with improved foot operable control, comprising an outer housing mountable on a bottom end of a ladder and, slidably coupled to the outer housing, an adjustable ladder leg extension having a direction of extension and an opposite direction of retraction. The outer housing and the leg extension together present a shoe-contactable boundary around the leveler defined as the limit of locations on or near the outer housing and the leg extension that can be contacted by a sphere of 7½ inches diameter (the typical curvature of the inside or outside ball of the foot of a typical shoe).

A spring is coupled to the leg extension and to the outer housing. It urges the leg extension to slide in the direction of retraction. A retaining pawl releaseably connects the outer housing and the leg extension. When the pawl is engaged, it holds the leg extension from sliding in the direction of retraction. The retaining pawl has a release lever.

A foot pedal is coupled at its proximal end via a pivot to the leg extension. The pivot and the foot pedal are configured so that, when pivoted into an action position, the foot pedal presents a foot engagable surface that is perpendicular to the direction of extension and transmits to the leg extension a force applied by a foot in opposition to the spring, causing the extension to extend.

The improvement is that the pivot and the foot pedal are further configured so that, when the foot pedal is pivoted into a non-action position, the distal end of the foot pedal protrudes to form a foot engageable ledge perpendicular to and extending at least 1/8 inch beyond the shoe-contactable boundary so that a human's shoe moving in the direction of extension along the outer housing and the leg extension will catch the foot pedal and cause it to pivot into an action position. For better functionality, the distal end of the foot pedal may protrude at least 5/16 inch beyond the outer shoe-contactable boundary, preferably 9/16 inch beyond the shoe-contactable boundary.

The release lever may also have a distal end protruding at least 1/4 inch beyond the outer shoe-contactable boundary of the outer housing and the leg extension so that a human's shoe moving in the direction of extension along the outer housing and the leg extension will catch the release lever to release the pawl. The distal end of the release lever may have a lip extending in the direction of retraction so that a shoe can more easily catch and engage the release lever. For better functionality, the distal end of the release lever may protrude at least 3/8 inch beyond the outer shoe-contactable boundary, preferably 9/16 inch beyond the shoe-contactable boundary.

In another aspect, the invention is an extendable and adjustable ladder leg with an improved shoe with a claw, comprising an extendable and adjustable ladder leg extension having a longitudinal direction of extension and an opposite longitudinal direction of retraction and having a shoe hingedly coupled to a distal end of the leg extension in a way that gives the shoe a range of hinging motion with respect to the hinge and a range of longitudinal motion with respect to the leg extension. The shoe has a hinge pin that forms a hinge axis, as well as a first end that is most distant from the hinge axis, and a second end that is most distant from the first end.

The adjustable ladder leg has a safety bar slidably mounted on the leg extension and coupled to the shoe such that the safety bar moves in the direction of retraction with respect to the leg extension when the shoe moves in the direction of retraction with respect to the leg extension, the safety bar thereby preventing release of a release mechanism that, when activated, releases the leg extension to move in the direction of retraction.

The improvement comprises the shoe having a toothed claw on at least one of the first end or the second end; the shoe including cut-outs that allow the shoe to hinge 180 degrees about the hinge axis when the extension leg is fully retracted; and the shoe including retaining surfaces that contact parts of the leg extension and retain the claw in a fully hinged position when force is applied along the leg extension in the direction of retraction, urging the claw against an object which the claw grips. In addition, the shoe and leg extension parts are configured such that, when the shoe is in a fully hinged position and force is applied along the leg extension in the direction of retraction, the shoe can move toward the leg extension to actuate the safety bar and thereby prevent activation of the release mechanism.

The retaining surfaces that contact parts of the leg extension and retain the shoe in a fully hinged position may comprise part of a circumference of each of two triangular holes, one in each of two sidewalls of the shoe, which retaining surfaces contact a hinge pin coupled to the leg extension.

The triangular holes may each include at least one slope in its circumference which slope is a retaining surface that applies a lateral force to the shoe via contact with the hinge pin when weight is applied to the leg extension while the ladder leg is in an erected position and the shoe is in a fully hinged position.

The retaining surfaces that contact a part of the leg extension and retain the shoe in a fully hinged position may comprise an upper side of a support base of the shoe which upper side contacts a lower corner of the leg extension to retain the shoe in a fully hinged position. In this case, the retaining surfaces also comprise part of a circumference of each of two holes, one in each of two sidewalls of the shoe, which holes, when the shoe is in a fully hinged position, are longer in the longitudinal direction than a diameter of the hinge pin, such that the shoe can move in the direction of retraction with respect to the leg extension after the shoe is in a fully hinged position and thereby place the retaining surfaces in position to retain the shoe in a fully hinged position and simultaneously actuate the safety bar.

In another aspect, the invention is a ladder leg with an improved shoe with a claw, comprising a ladder leg having a longitudinal direction along the leg, having a bottom end, and having a shoe hingedly coupled to the bottom end of the leg in a way that gives the shoe a range of hinging motion with respect to the hinge and a range of longitudinal motion with respect to the leg, the shoe having a hinge pin that forms a hinge axis, a first end that is most distant from the hinge axis, and a second end that is most distant from the first end. The shoe has a toothed claw on at least one of the first end or the second end. The shoe and bottom end of the leg are configured to allow the shoe to hinge about the hinge axis to a point where the shoe base is parallel to the leg.

The improvement comprises: the shoe and leg each have retaining surfaces that contact each other and retain the shoe in a fully hinged position, which retaining surfaces comprise: an upper side of a support base of the shoe which upper side contacts a lower corner of the leg to retain the shoe in a fully hinged position; and a part of a circumference of each of two holes, one in each of two sidewalls of the shoe, which holes, when the shoe is in a fully hinged position, are longer in the longitudinal direction than a diameter of the hinge pin, and the part of the circumference of each of two holes contacting the hinge pin retain the shoe in a fully hinged position. In this event, the shoe can move in the direction of retraction with respect to the leg after the shoe is in a fully hinged position and thereby place the retaining surfaces in position to retain the shoe in a fully hinged position. The two holes may each be triangular in shape.

DETAILED DESCRIPTION

Ladder Shoe with Fastener Holes

Figure 1:
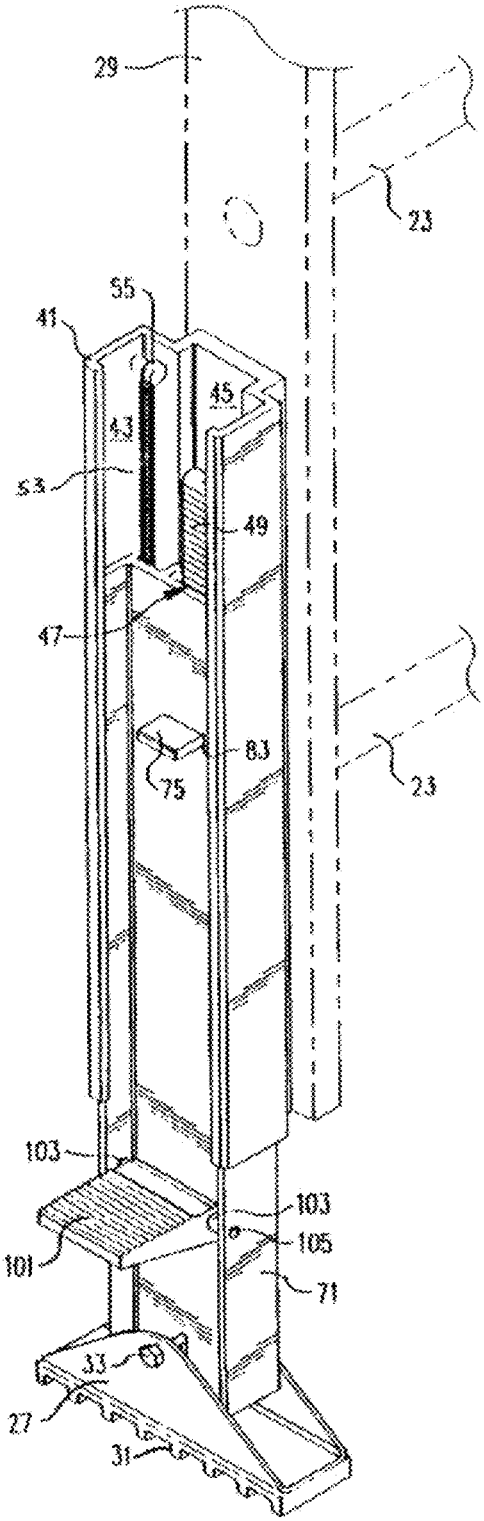
FIGS. 1 and 2 show the prior art ladder leveler with an adjustable extendable leg.
Figure 2:
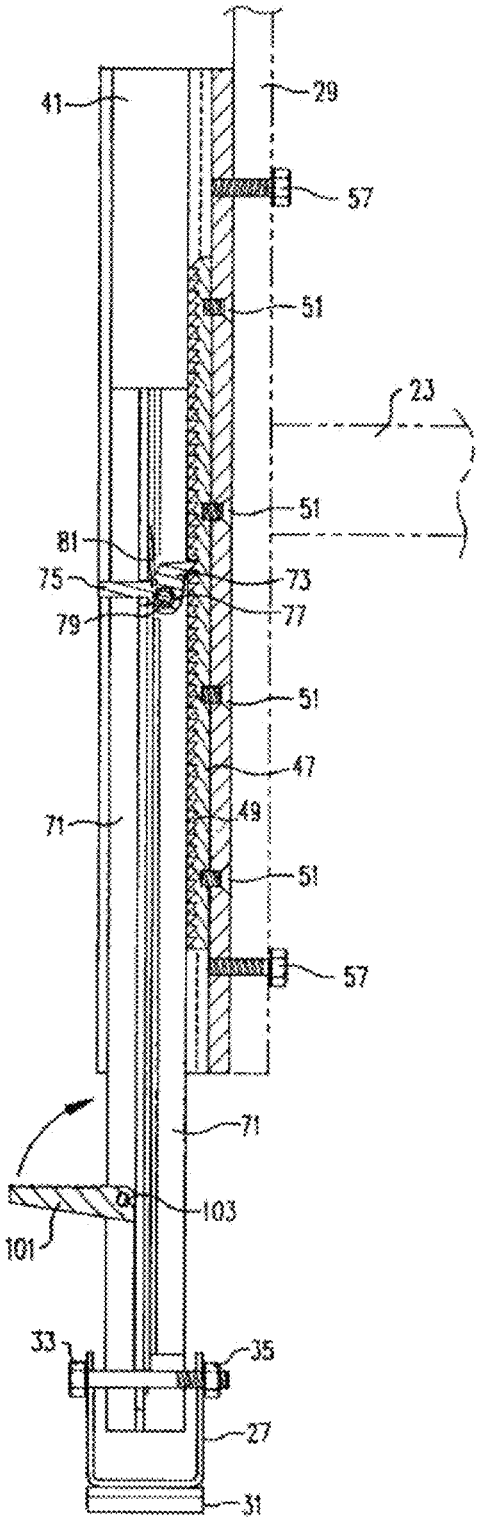
Figure 3:
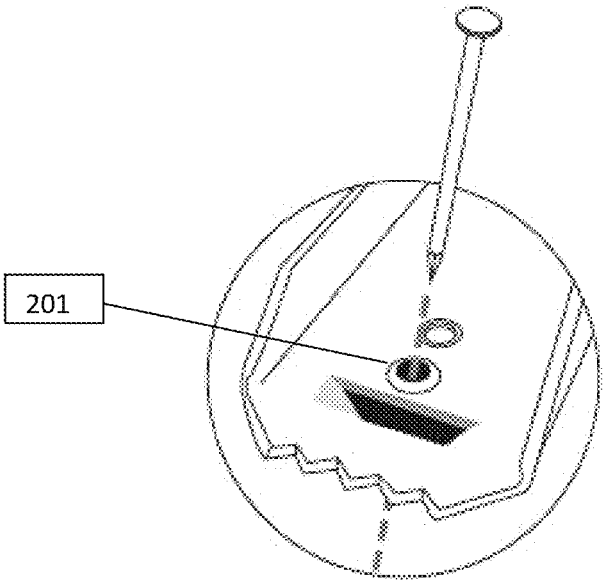
FIG. 3 shows the hole in the shoe for nailing.
Figure 4:
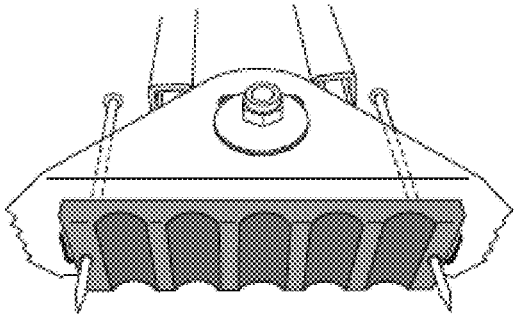
FIG. 4 shows two nails through the holes and through aligned holes in the rubber tread portion of the shoe.

As shown in FIGS. 3 and 4, fastener holes 201 in the ladder shoe allow nails or screws or other fasteners to be inserted into dirt or wood or other material on which the ladder is erected to provide extra grip. Instead of holes, slots may be placed in the shoe. Most ladder shoes include a rubber tread 31 below a metal support structure 27. The tread may also have aligned holes so the nails can pass through both the metal structure and the rubber tread as shown in FIG. 4. These holes in both the metal and the rubber tread make the shoe lighter, which is always a design advantage for ladders. The holes are located near the ends of the shoe, large enough to slide a nail or similar, sharp or narrow, or thin metal or plastic piece through the hole or holes to penetrate a slippery surface, thereby providing additional non-slip features to the bottom surface of the shoe. The shoe will preferably include a claw on each end as shown in FIGS. 3 and 4, and the holes are near the claws.

The hole or slot in the metal portion of the shoe can be the same size or slightly larger than the penetrating object, (i.e. 16d framing nail) to minimize any friction between the two objects, but the rubber tread underneath the metal portion can be slightly smaller than the penetrating object so that the rubber tread grips the penetrating object tightly, thereby minimizing the chance of it sliding back up and out too easily.

The penetrating object may be slid into the hole or slot when a ladder or leveler is set up on a slippery surface, as an added safety measure. An example would be setting up a ladder on a mossy deck. A nail can be slid through the leveler shoe hole and in between the grooves in between deck boards. A 16d framing nail, or sinker, is the most common nail found on a construction site, used for general framing, temporary scaffolding, saw horses, etc. A 16d framing nail placed in a slightly larger hole in the metal, a slightly smaller hole in the tread make the best combination of holes and penetrating devices.

Figure 5:
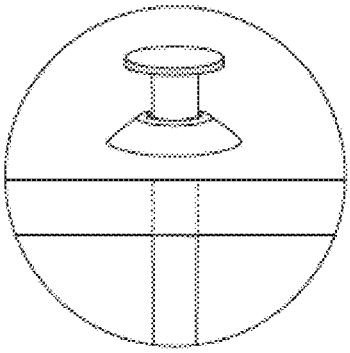
FIG. 5 shows the conical shaped raised metal around the hole to facilitate removing the nail.

Additionally, as shown in FIG. 5, the hole or holes in the shoe bottom can also have an upward protruding, semi-conical shape to allow easy removal of the nail. The smallest diameter portion of the semi-conical protrusion is located above the flat metal surface of the bottom portion of the shoe. This holds the head of the nail up and above the flat surface of the metal portion of the shoe, thereby enabling the claw of a hammer to grasp under the head of the nail to pull the nail more easily. A standard concrete form nail, with a double head, is another possible solution if a hole without the semi-conical shape is used in the shoe.

The rubber tread 31 located under the bottom, metal surface of the leveler shoe, and riveted on, also has holes of a slightly smaller diameter, in line with the holes in the metal portion of the shoe, so that the nail can penetrate all the way though the shoe assembly, including the holes in rubber tread, and in between deck boards, or the nail can be pounded into a wood surface, such as a subfloor on a new building or on a sheathed roof (sloped or not) of a new structure. The nails can also be used to penetrate into a lawn or any other soft surface that may be wet, moldy, mossy and/or slippery. These holes can also be shaped as slots that would enable a shim or other sharp device to be slid through to act as a securing, or non-skid device.

Claw Foot Locks in 90 Degree Rotation

Figure 6:
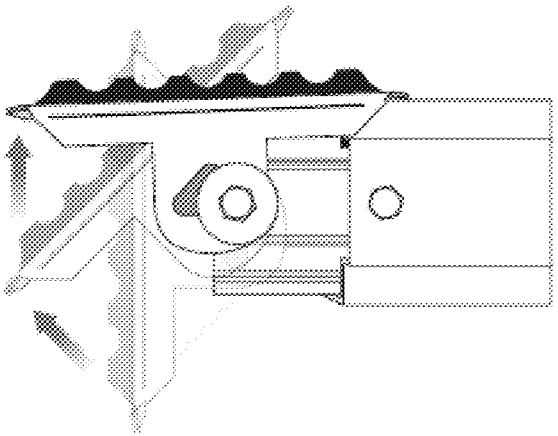
FIG. 6 shows the shoe with a triangular hole rotated 90 degrees but hanging low off the leg of the ladder.
Figure 7:
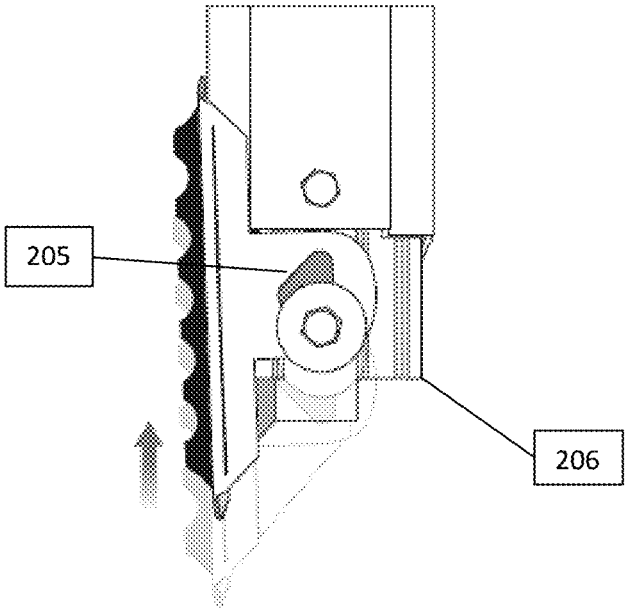
FIG. 7 shows the shoe still rotated 90 degrees but now pushed up from below so that the leg of the ladder extends lower than the triangular hole.

As shown in FIGS. 6 and 7, the shoe has been modified to enable it to pivot 90 degrees in one direction, or 90 degrees in the opposite direction, totaling a potential pivoting action of 180 degrees, without the need to extend leg extension when leg extension is fully retracted in the "ready" position and to slide up and down when pivoted 90 degrees. This feature enables the shoe to function as a claw that works in conjunction with the automatic, back-up safety mechanism of the leveler with extendable leg or with any ladder leg having a square bottom end of the leg.

The shoe has specially designed shapes and sizes, with carefully designed relationships between the shapes and sizes, including an elongated hole 205 through which a hinge pin couples the shoe to the ladder leg. When used together, these shapes and sizes and holes enable the bottom tread/claw surface and assembly of the shoe to pivot into the parallel position, in relation to the leg, and then, once pivoted into a parallel position, upward force applied to a claw end of the shoe will slide the shoe upward, the elongated hole allowing the hinge pin to move downward in the hole as shown in FIG. 7, so that a lower corner of the square bottom of the ladder leg 206 contacts the shoe bottom structure to prevent the shoe from pivoting out of the parallel position. The contact surfaces which retrain the shoe in position are a bottom corner of the ladder leg 206 contacting the inside of the horizontal base plate of the shoe and a portion of the inner circumference of the elongated hole 205 contacting the hinge pin (which is bolt 33 in the preferred embodiment). The hole 205 is elongated in a direction parallel to the shoe base and may also be triangular as shown in FIGS. 6 and 7.

In effect, the shoe becomes wrapped around the lower, outer leg, thus pointing the claw, on the desired end of the shoe, downward toward, and/or into the slippery surface on which the ladder is erected. These special shapes and dimensions allow the shoe to pivot and wrap around the bottom end of the lower leg, while working together with the automatic, back-up safety mechanism, and without any type of interference between the leveler leg, safety mechanism or shoe assembly. Both the shoe locking system and the release lever locking system will remain locked in their respective positions until weight is removed from the ladder leveler.

These new features provide a ladder leveler with a shoe and an automatic, back-up safety lock, having metal claws on either one or both ends of shoe, with the ability to pivot 180 degrees, slide up and down the leveler leg assembly and remain locked parallel to the leveler leg, thereby enabling the claw to dig into ice, snow or other slippery surfaces without concern for accidentally tripping the shoe to the flat position while on the ladder and without concern for retracting the leg extension.

There are various ways to achieve these results, including, but not limited to A.) specially designed, triangular shaped holes in two side flanges of leveler shoe as shown in FIGS. 6 and 7; B.) specially shaped and sized side flanges of the shoe; and C.) specially shaped and sized bottom support structure of the ladder shoe (attached to rubber tread). The shoe, with claw facing downward and penetrating or contacting a support surface, will not flatten out (down) when any weight or load is being applied to the ladder leveler, even if a load, sudden or otherwise, is applied from a direction that is different from the angle of the ladder leveler legs. The end result is that the claw shoe, automatic safety lock and primary ratchet lock all remain in the locked position as long as weight or load is applied to the ladder leveler leg or the ladder to which the leveler leg is attached, even if the load (sudden or gradual) is applied to the side, back, front or top of the ladder leveler or ladder to which the ladder leveler is attached.

This invention provides much more versatility in the ladder leveler because it enables the ladder user to quickly and easily flip the leveler shoe all the way back or forward, allowing the inside, upper surface of the bottom portion of the shoe to slide up against the leg, thereby activating the automatic, back-up, safety mechanism up against the pawl (and its release lever), thereby keeping the pawl locked, without the need to extend the leg extension several inches beforehand. This option enables a ladder user, who prefers not to extend the leveler leg, to easily use the claw on either end of the shoe (double claw shoe—front and back) when setting up a ladder on flat, even surfaces, or uneven surfaces, with ladder levelers that have automatic, back-up safety mechanisms installed.

Lever Controls Actuatable with a Person's Foot

Figure 8:
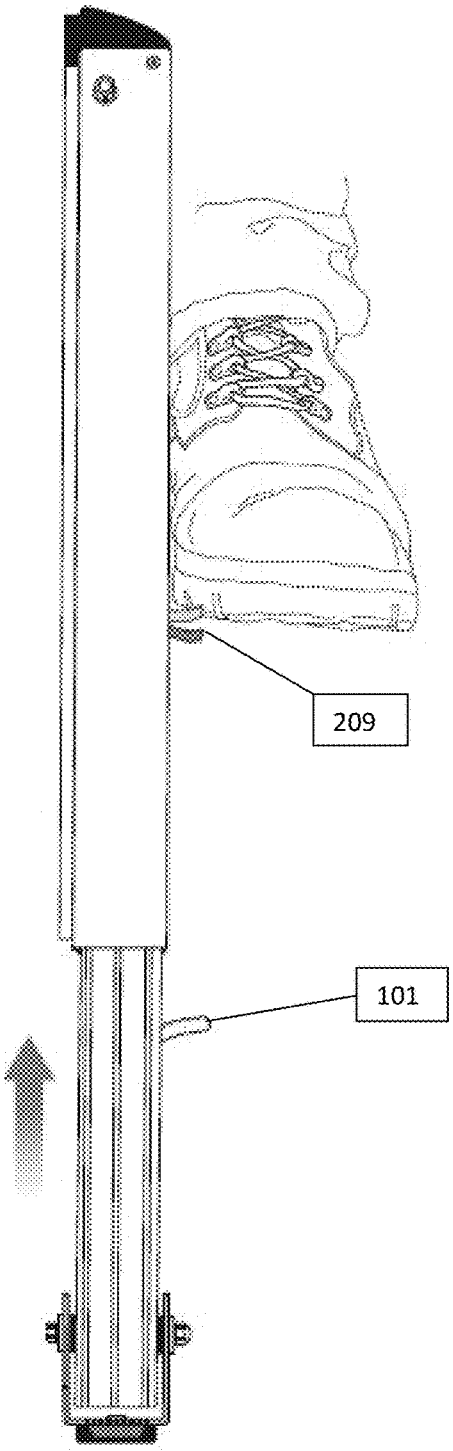
FIG. 8 shows the lower foot pedal in a folded position and the upper release lever, each extending outward enough to be operable with a person's foot (shoe).
Figure 9:
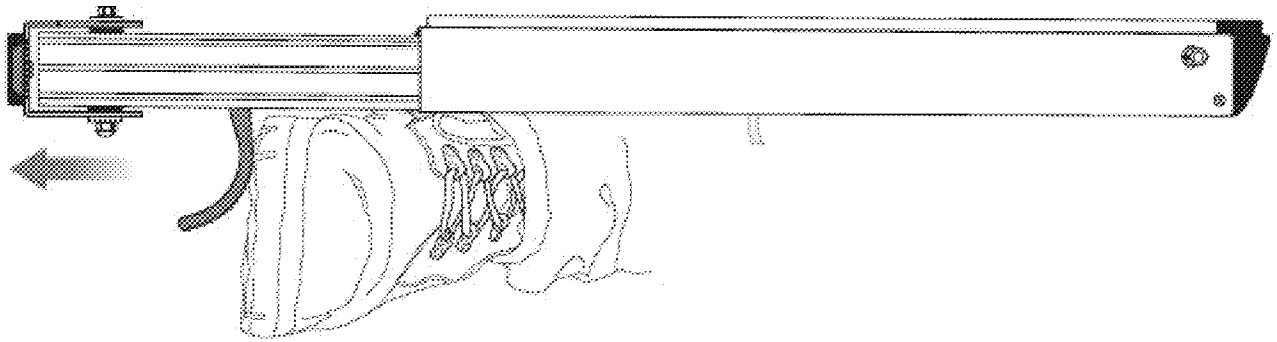
FIG. 9 shows the lower foot pedal in the unfolded position for extending the leg.

As shown in FIGS. 8 and 9, the release lever 75, which is the upper of the two levers, is modified in its length and its shape so that it protrudes at least ¼", better ⅜", preferably 9⁄16", but not more than 1", beyond the shoe-contactable boundary of the leveler, creating a preferred relationship between the outer surfaces of the leveler and outer portion of the release lever. Preferably, the tip of the lever 209 has a upward curve. This improvement enables the user to depress the lever with his or her foot, shoe or toe, more quickly, ergonomically and with less physical effort. The proximity and immediate relationship between the two parts (outer surface of the leveler and the release lever) is critically important in how the locking system will respond when touched with a foot, and also in relation to the automatic, back-up, safety mechanism, which is deactivated when weight (load) is removed from the leveler shoe.

The increased length of the release lever adds significantly to the ease of operation by creating quick and easy access to the lever, even when a person with large feet (large shoes) is attempting to depress the lever to release the locking system and retract the leg extension. The slight upward bend 209 in the release lever, located approximately ¼" from the outermost tip of the lever, creates an angled edge for shoes that may be slippery from being wet, muddy or smooth from wear that is much easier to snag with a foot or toe. Additionally, the top surface of the lever, including the upwardly curved tip 209, has grooves in it for extra grip. The release lever is also shaped so that it will not protrude from the outside face of the ladder leveler to a point at which it would be considered overly obtrusive, thereby creating interference, when the leveler is not in use and/or the ladder and leveler combination is being carried or stored.

As shown in FIGS. 8 and 9, the foot pedal 101, which is the lower of the two levers, is modified in its length and its shape to enable the ladder user to quickly and easily catch the foot pedal of a ladder leveler with the bottom of a shoe or side of a shoe when the foot pedal needs to be snapped downward to the "READY" position for quickly extending the inner ladder leveler leg, thereby creating a faster, safer leveling operation without the need to bend over to use a hand to snap the foot pedal down into the "READY" position.

The proximity and immediate relationship between the two parts (leveler's outer surface and the foot pedal) is critically important in how the foot pedal/locking system will respond when touched with a foot or shoe, particularly in relation to the automatic, back-up, safety mechanism, which is deactivated when weight (load) is removed from the leveler shoe, and activated when weight is placed on the leveler shoe. The special shape is designed so that it is easier to snap up and snap down with a foot, while activating or deactivating the back-up, automatic safety mechanism. This special shape, combined with the extra length (at least ⅛" beyond the shoe-contactable boundary of the leveler, better 5/16", preferably 9/16", and no more than 1" beyond the shoe-contactable boundary the leveler) is a more ergonomic shape, is easier to reach, and is combined with grooves running perpendicular to the length of the foot pedal for added non-slip features. The foot pedal is also shaped so that it will not protrude from the outside face of the ladder leveler to a point at which it would be considered overly obtrusive, thereby creating interference, when the leveler is not in use and/or the ladder and leveler combination is being carried or stored.

The invention claimed is:

1. A ladder leg extension comprising:

an outer housing;

a leg extension movable longitudinally in first and second directions relative to the outer housing between a retracted position and an extended position, the leg extension having an opening extending therethrough proximate a bottom of the leg extension;

a bolt extending through the opening; and a shoe having an engagement base and first and second sidewalls extending upward form the engagement base, wherein each of the first and second sidewalls have an elongate hole through which the bolt extends to pivotally connect the shoe to the leg extension, wherein the first sidewall is triangular in shape with rounded corners a rounded top, and wherein the second sidewall has a horizontal portion extending upward from the engagement base and a vertical portion extending upward from the horizontal portion perpendicular to the horizontal portion thereby forming cutouts such that second sidewall is configured to avoid contacting a ladder rail or the outer housing when the leg extension is in the retracted position and when the shoe is moved from a first position where the engagement base is perpendicular to the leg extension to a second position where the shoe is fully hinged where the engagement base is parallel the leg extension, wherein each elongate hole is triangular in shape, and wherein each triangular shaped hole has a horizontal portion parallel the horizontal portion of the second side wall, and a pair of angled portions angled towards one another and extending downward from the horizontal portion.

2. The ladder extension according to claim 1, wherein when weight is applied to the leg extension when the shoe is in the first position, the bolt is configured to contact the horizontal portions of each triangular shaped hole.

3. The ladder extension according to claim 2, wherein when weight is applied to the leg extension when the shoe is in the second position, the shoe is retained in the second position.

4. The ladder extension according to claim 1, further including a friction pad tread attached to a bottom of the engagement base.

* * * * *